US007726045B2

(12) United States Patent
Riebesell

(10) Patent No.: US 7,726,045 B2
(45) Date of Patent: Jun. 1, 2010

(54) SHOE CONSTRUCTION WITH FOLD OVER ANKLE

(75) Inventor: Noemi Riebesell, Clinton, MA (US)

(73) Assignee: Converse Inc., North Andover, MA (US)

( * ) Notice: Subject to any disclaimer, the term of this patent is extended or adjusted under 35 U.S.C. 154(b) by 833 days.

(21) Appl. No.: 11/536,460

(22) Filed: Sep. 28, 2006

(65) Prior Publication Data

US 2008/0078105 A1 Apr. 3, 2008

(51) Int. Cl.
*A43B 3/24* (2006.01)
*A43B 23/02* (2006.01)
*A43B 23/26* (2006.01)

(52) U.S. Cl. ..... 36/100; 36/109; 36/54; 36/45

(58) Field of Classification Search ..... 36/100, 36/109, 54, 45, 1.5
See application file for complete search history.

(56) References Cited

U.S. PATENT DOCUMENTS 159,245 A * 2/1875 Bryant ..... 36/54
1,538,104 A * 5/1925 Foster ..... 36/11
2,095,880 A * 10/1937 Koenig ..... 36/7.3
2,357,980 A * 9/1944 Spiro ..... 36/50.1
2,718,715 A * 9/1955 Spilman ..... 36/12
3,618,232 A * 11/1971 Shnuriwsky ..... 36/1.5
4,370,818 A * 2/1983 Simoglou ..... 36/100
D299,786 S * 2/1989 Swett ..... D2/970
5,533,279 A * 7/1996 Mitsui et al. ..... 36/50.1

* cited by examiner

*Primary Examiner*—Ted Kavanaugh
(74) *Attorney, Agent, or Firm*—Shook, Hardy & Bacon LLP

(57) ABSTRACT

A novel shoe construction provides a unique aesthetically pleasing appearance to a shoe that can be easily, but significantly, changed. In the shoe construction, the shoe is provided with an upper ankle portion that has an elongate length that extends upwardly from the shoe sole. The length of the ankle portion allows a top part of the ankle portion to be folded downwardly over a bottom part of the ankle portion to produce a first appearance of the shoe. The top part of the ankle portion can be unfolded to extend upwardly from the bottom part of the ankle portion to produce the second appearance of the shoe.

12 Claims, 4 Drawing Sheets

SHOE CONSTRUCTION WITH FOLD OVER ANKLE

BACKGROUND OF THE INVENTION (1) Field of the Invention

The present invention pertains to a novel shoe construction that provides a unique aesthetically pleasing appearance to a shoe that can be easily changed. In particular, the present invention pertains to a shoe construction in which the shoe is provided with an upper ankle portion that has an elongated length that extends upwardly from the shoe sole. The length of the ankle portion allows a top part of the ankle portion to be folded downwardly over a bottom part of the ankle portion to produce a first appearance of the shoe. The top part of the ankle portion can be unfolded to extend upwardly from the bottom part of the ankle portion to produce the second appearance of the shoe.

(2) Description of the Related Art

The high-top lace-up basketball shoe has been a very popular shoe for athletics for many years. In more recent years, in addition to the use of the shoe in athletics, the shoe has also become very popular as a comfortable casual shoe that has an aesthetically pleasing appearance. Shoes of this type are known as athleisure shoes. This is particularly true of the high-top lace-up basketball shoe that has an upper constructed of a flexible, breathable fabric, for example canvas.

With the increasing popularity of the high-top basketball shoe or athleisure shoes in general, new appearances have been sought for the shoe to maintain the marketability of the shoe by keeping up with the latest trends in fashion. However, in order to maintain the comfortable construction of the shoe, changes to the shoe to keep up with fashion trends have been limited to changes in the color or pattern of the fabric employed in manufacturing the shoe. However, the colors or patterns of material employed in constructing the shoe are limited, creating a need to provide a new and aesthetically pleasing appearance of the shoe without detracting from the comfortable construction of the shoe.

SUMMARY OF THE INVENTION

The present invention overcomes the problem of providing a new and aesthetically pleasing appearance of a high-top lace-up basketball shoe without detracting from the comfortable construction of the shoe, and while providing the shoe with the ability to significantly change the appearance of the shoe. The invention provides a novel modification to the shoe construction without substantially changing the original shoe construction. The athleisure shoe of the invention has basically the same construction as the popular high-top lace-up basketball shoe, but with an elongated ankle portion of the shoe upper. The elongated ankle portion has a bottom part that is dimensioned substantially the same as a conventional high-top basketball shoe, and a top part that extends upwardly from the bottom part and can be worn upward, or folded downward over the bottom part.

The shoe construction of the present invention has a shoe sole that is substantially the same as the shoe sole employed in the construction of a typical athleisure shoe, for example a basketball shoe. The shoe construction of the invention also includes an upper that extends upwardly from the shoe sole to a top edge of the upper. The top edge of the upper defines a forefoot opening of the shoe and an ankle opening of the shoe that provide access to the shoe interior for the shoe wearer's foot. A tongue also extends upwardly from the shoe sole through the forefoot opening. An adjustable fastener, preferably lacing, extends across the forefoot opening and adjustably secures together the opposite sides of the upper over the tongue and the shoe wearer's foot by tightening and tying the lacing, all of which are conventional.

The novel construction of the shoe of the invention is provided by an elongated configuration of the ankle portion of the shoe upper. The elongated configuration of the ankle portion has a bottom part that extends upwardly from the shoe's sole and surrounds the heel and the back portion of a shoe wearer's foot, in substantially the same manner as a conventional high-top she. The ankle portion top part extends from the ankle portion bottom part. The ankle portion is foldable between the bottom part and the top part. The elongated configuration of the ankle portion enables the top part to be moved between a folded position where the top part is folded downwardly over the bottom part of the ankle portion, and an unfolded position where the top part extends upwardly from the bottom part. With the ankle portion top part in the unfolded position, the ankle portion top part extends upwardly beyond the shoe wearer's ankle and around a lower portion of the shoe wearer's calf. The shoe has a first appearance when the ankle portion top part is folded over the ankle portion bottom part, and the shoe has a second, substantially different appearance when the ankle portion top part is unfolded and extends upwardly from the ankle portion bottom part.

Thus, the shoe construction with the elongated upper ankle portion gives the shoe a novel aesthetically pleasing appearance that can be easily and substantially changed, without detracting from the comfortable construction of the shoe.

BRIEF DESCRIPTION OF THE DRAWINGS

Further features of the invention are set forth in the following detailed description of the preferred embodiment of the invention and in the drawing figures.

DETAILED DESCRIPTION OF THE PREFERRED EMBODIMENT

Figure 1:
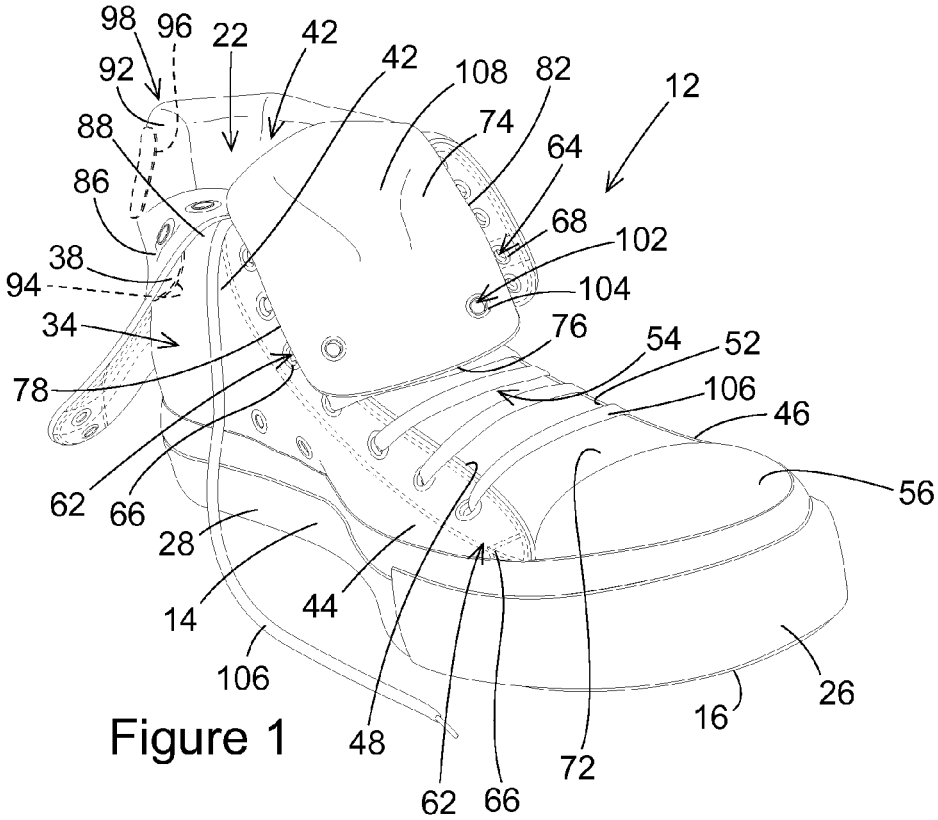
FIG. 1 is a perspective view of the front of a left shoe of the invention, with the right shoe of the invention having a construction that is a mirror image duplicate of the left shoe construction.
Figure 2:
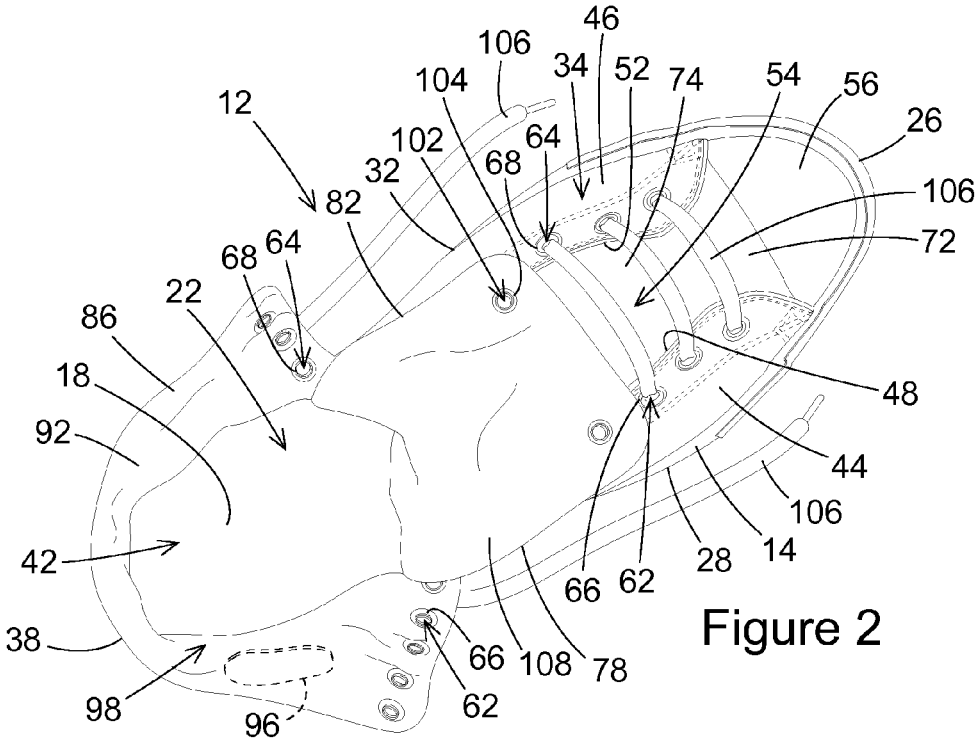
FIG. 2 is a top plan view of the shoe shown in FIG. 1.
Figure 3:
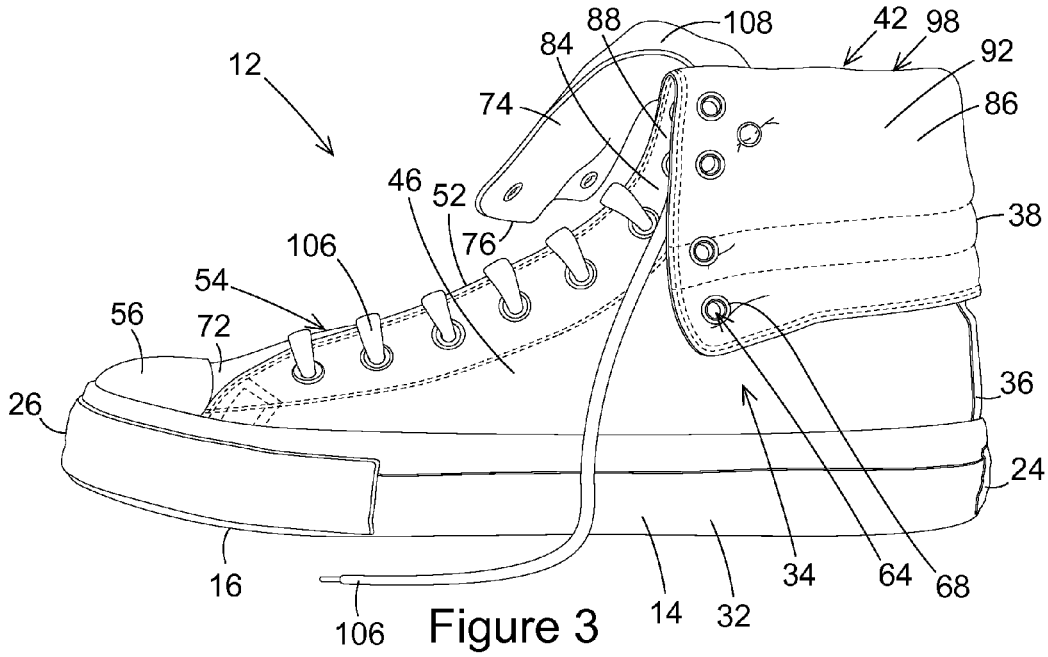
FIG. 3 is a left side elevation view of the shoe shown in FIG. 1.
Figure 4:
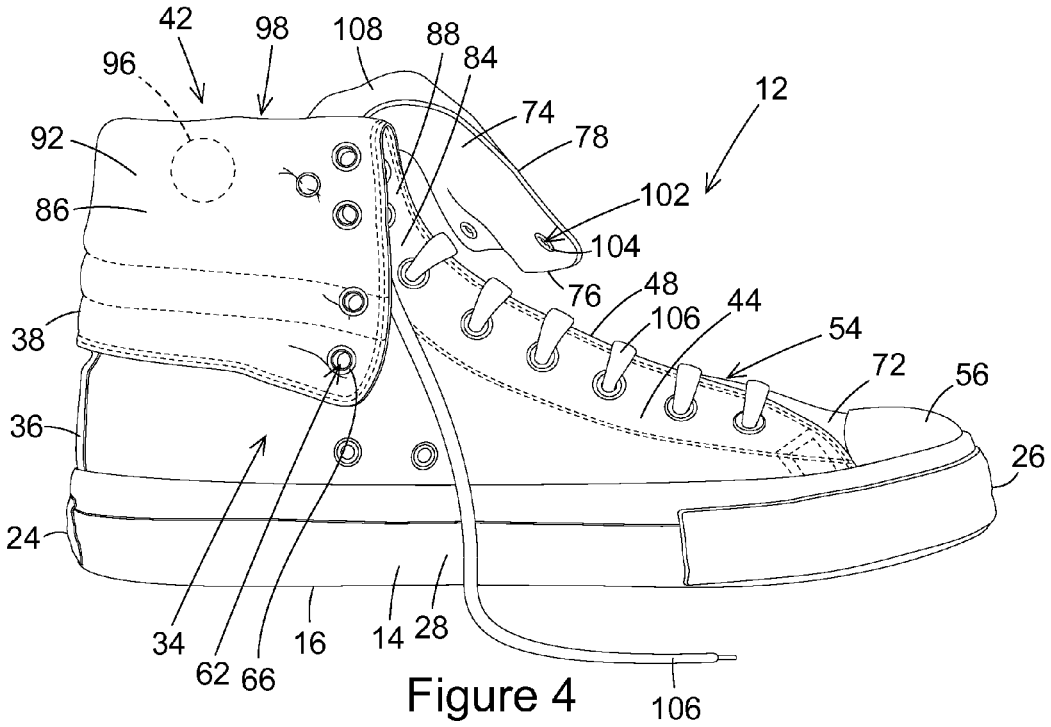
FIG. 4 is a right side elevation view of the shoe shown in FIG. 1.
Figure 5:
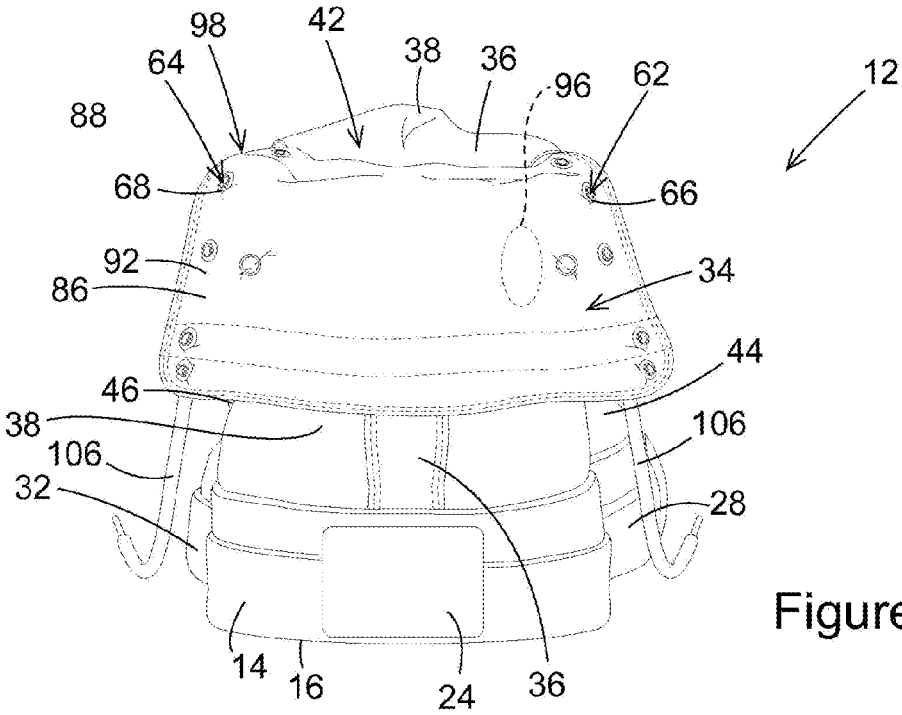
FIG. 5 is a rear elevation view of the shoe shown in FIG. 1.
Figure 6:
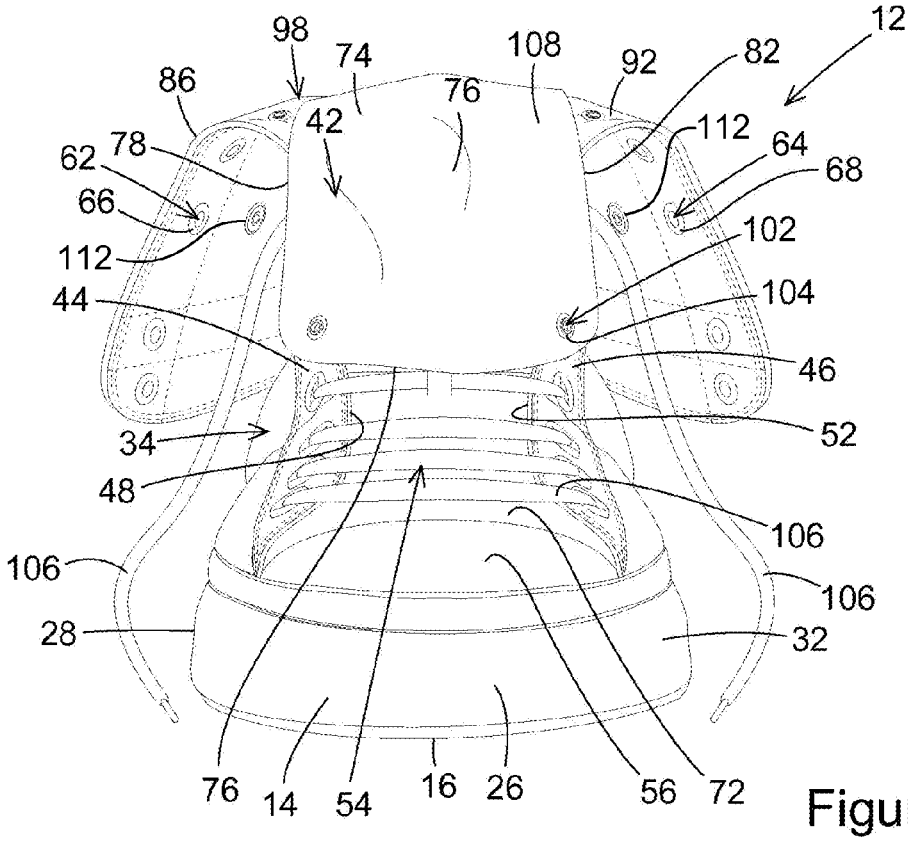
FIG. 6 is a front elevation view of the shoe shown in FIG. 1.

The construction of the fold over ankle athleisure shoe 12 of the present invention has the basic construction of a high-top lace-up basketball shoe. The exception is that the novel construction of the shoe 12 provides the shoe with an elongated ankle portion of the shoe upper that can be folded over downwardly for one appearance, or unfolded upwardly for a second appearance. This provides the shoe with two unique, aesthetic appearances. In the preferred embodiment of the shoe 12 shown in the drawing figures, the shoe is a high-top basketball shoe. However, it should be understood that the novel concept of the invention could be employed on other types of shoes. Because much of the construction of the shoe 12 of the invention is the same as that of a conventional high-top lace-up shoe, the conventional features of the construction will be described only generally herein.

The shoe 12 has a shoe sole 14 that is constructed of resilient materials that are typically employed in the construction of soles of athletic shoes. The sole 14 can be constructed with an outsole, a midsole, and an insert, as is conventional. The shoe sole 14 has a bottom surface 16 that functions as the traction surface of the shoe, and an opposite top surface 18 in the interior 22 of the shoe. The size of the shoe 12 has a length that extends from a rear heel end 24 to a front toe end 26 of the sole, and the shoe 12 has a width that extends between a right side 28 and a left side 32 of the shoe sole.

The shoe upper 34 is secured to the shoe sole 14 and extends upwardly from the shoe sole top surface 18, as is conventional. The upper 34 is constructed of a flexible material, for example leather or a fabric such as canvas. The upper 34 is constructed with a heel portion 36 that extends around the shoe sole top surface 18 at the shoe sole heel end 24. The upper heel portion 36 extends upwardly from the shoe sole 18 to an ankle portion 38 of the upper that defines an ankle opening 42 into the shoe interior 22.

From the heel portion 36, the upper 34 has a right side portion 44 and a left side portion 46 that extend forwardly along the respective shoe sole right side 28 and shoe sole left side 32. The upper right side portion 44 extends upwardly from the shoe sole right side 28 to an upper right side edge 48. The upper left side portion 46 extends upwardly from the shoe sole left side 32 to an upper left side edge 52. As seen in the drawing figures, the upper right side edge 48 and the upper left side edge 52 extend rearwardly from opposite sides of the front toe end 26 of the shoe sole. The length of the upper right side edge 48 and the upper left side edge 52 define a forefoot opening 54 in the shoe upper 34 that opens to the shoe interior 22.

The upper 34 is also constructed with a toe box or toe cap 56 that extends around and across the shoe sole top surface 18 at the shoe sole toe end 26. The toe box 56 is connected between the upper right side portion 44 and the upper left side portion 46 and encloses a portion of the shoe interior 22 adjacent the shoe sole toe end 26. The upper right side edge 48 and the upper left side edge 52 extend rearwardly from the toe box 56.

A first plurality of apertures 62 are provided on the upper right side portion 44 and a second plurality of apertures 64 are provided on the upper left side portion 46. The apertures 62, 64 are preferably lacing openings, meaning openings on the shoe upper that are typically occupied by a portion of the lacing that closes the shoe upper over the forefoot opening of the shoe. The apertures 62, 64 can be provided by any known means of providing lacing openings on shoes, for example D-rings or speed lacing hooks. However, in the preferred embodiment of the invention, the apertures 62, 64 are provided by a first plurality of eyelets or grommets 66 on the upper right side portion 44 and a second plurality of eyelets or grommets 68 on the upper left side portion 46. The eyelets 66, 68 provide the desired conventional lace-up shoe appearance. The apertures 62, 64 are arranged in lines along the upper right side edge 48 and along the upper left side edge 52, as is conventional. As is seen in the drawing figures, the apertures 62, 64 extend substantially the entire lengths of the upper right side edge 48 and the upper left side edge 52.

The shoe upper 34 includes a vamp 72 or throat positioned rearwardly of the toe box 56, and a tongue 74 that extends rearwardly from the vamp 72 through the forefoot opening 54. The tongue 74 extends along the lengths of the upper right side portion 44 and the upper left side portion 46 to a distal end 76 of the tongue. The tongue 74 has a width between a right side edge 78 and a left side edge 82 of the tongue. The length and width of the tongue position the tongue side edges beneath the upper right side portion 44 and the upper left side portion 46, respectively, and extend the tongue over the forefoot opening 54 of the shoe.

The unique construction of the invention is provided by an elongated configuration of the ankle portion 38 of the shoe upper 34. The length of the ankle portion 38 is significantly larger than that of a conventional high-top basketball shoe. The elongated length of the ankle portion 38 includes a bottom part 84 of the ankle portion that is basically positioned in the same position as an ankle portion of a conventional high-top basketball shoe, and a top part 86 of the ankle portion that extends from the bottom part 84. The ankle portion bottom part 84 and top part 86 have opposite exterior 88 and interior 92 surfaces. The exterior surface 88 of the two parts 84, 86 of the ankle portion is an extension of the material of the upper 34 and has the same appearance as the material of the upper. In the preferred embodiment of the invention, the interior surface 92 of the two parts 84, 86 of the ankle portion 38 is constructed of a different material from the exterior surface 88 and has a second, different appearance from that of the exterior surface. In addition, a first indicia 94 is provided on the exterior surface 88 at the ankle portion bottom part 84, and a second indicia 96 is provided on the ankle portion interior surface 92 at the top part 86 of the ankle portion. These indicia 94, 96 can be different. However, in the preferred embodiment the indicia 94, 96 are the same and preferably are a trademark identifying the source of the shoe 12.

The elongated length of the ankle portion 38 enables the ankle portion to be folded at a fold area 98. This enables the ankle portion top part 86 to be moved to a folded-over position over the exterior surface of the ankle portion bottom part 84 as shown in FIGS. 1-6. In this position of the ankle portion top part 86 over the ankle portion bottom part 84, the ankle portion interior surface 92 is displayed over the exterior surface 88 of the ankle portion bottom part 84. By being displayed, what is meant is that the interior surface 92 of the ankle portion top part 86 is more visible from the exterior of the shoe with the ankle portion top part 86 folded over the ankle portion bottom part 84. The second indicia 96 is also displayed over the first indicia 94. With the ankle portion top part 86 moved to the folded-over position shown in drawing FIGS. 1-6, the shoe 12 of the invention has a first aesthetically pleasing appearance.

Figure 7:
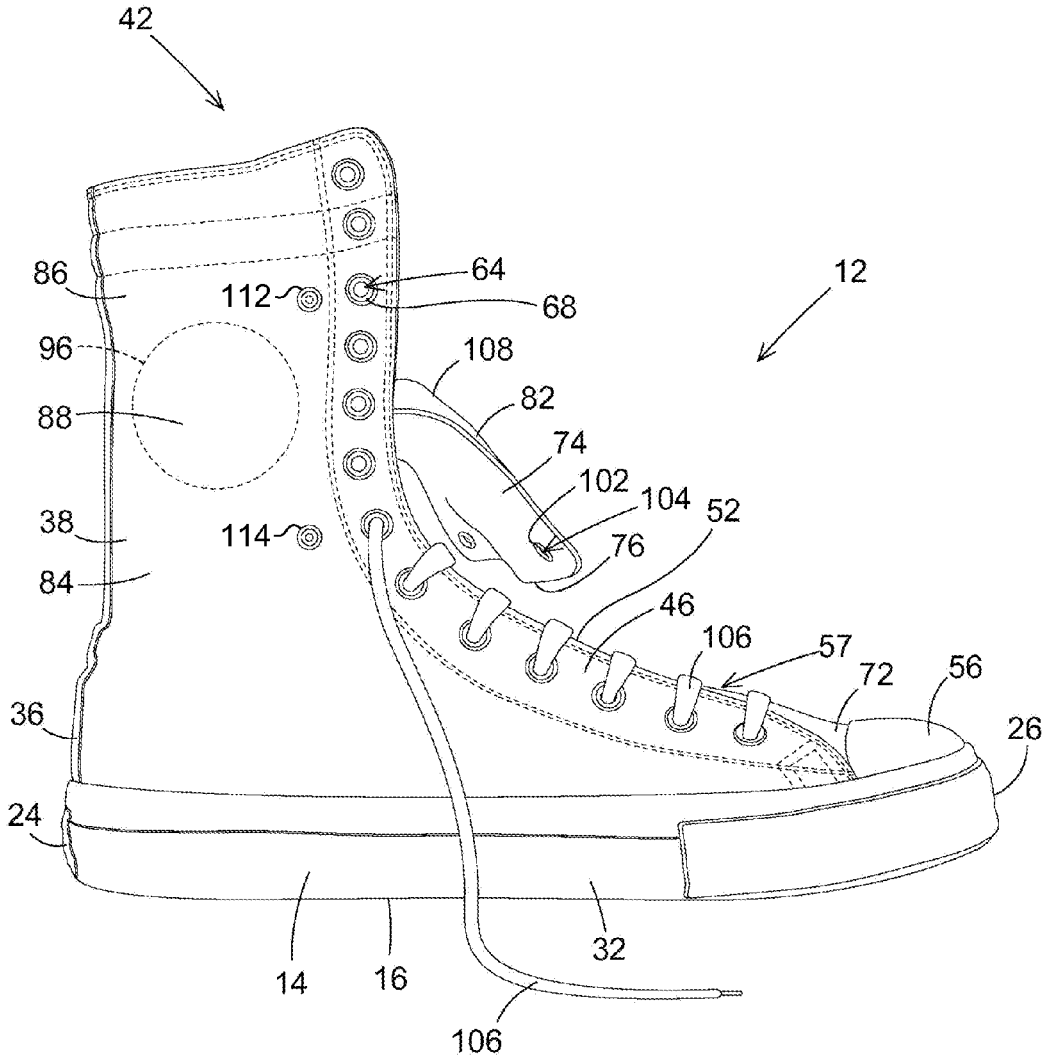
FIG. 7 is a right side elevation view of the shoe with the upper ankle portion unfolded.

The ankle portion top part 86 can also be unfolded upwardly at the fold area 98 so that the top part 86 extends upwardly from the ankle portion bottom part 84. This is the configuration shown in FIG. 7. In this configuration, the exterior surface of the ankle portion bottom and top parts 84, 86 is displayed at the exterior of the shoe 12. This configuration of the shoe shown in FIG. 7 gives the shoe an aesthetically pleasing appearance that is significantly different from the appearance of the shoe shown in FIGS. 1-6. In the unfolded position of the ankle portion top part 86 the first indicia 94 is displayed and the second indicia 96 faces the interior 22 of the shoe. It can be seen in FIG. 7 that the elongated length of the ankle portion 38 in the unfolded position extends the ankle portion 38 upwardly to an extent where it will cover over the shoe wearer's ankle and a lower portion of the shoe wearer's calf.

In the preferred embodiment of the invention the first plurality of eyelets 66 and second plurality of eyelets 68 extend upwardly over the extended length of the ankle portion 38. Also in the preferred embodiment of the invention, the tongue 74 has an elongated length that positions the tongue distal end 76 adjacent the top edge of the ankle portion 38 when the ankle portion is moved to the unfolded position shown in FIG. 7. The tongue 74 has a pair of apertures 102 adjacent its distal end 76 provided by a pair of tongue eyelets 104. With the tongue extended to an upright configuration where the tongue distal end 76 is positioned adjacent the top of the unfolded ankle portion 38, the tongue eyelets 104 are positioned adjacent the topmost eyelets of the first plurality of eyelets 66 and the second plurality of eyelets 68 on the shoe upper.

Adjustable fasteners extend across the forefoot opening 54 and across the tongue 74 positioned in the forefoot opening of the shoe. The adjustable fasteners adjustably connect the upper right side portion 44 with the upper left side portion 46. In the preferred embodiment of the invention, the adjustable fasteners are provided in the form of a shoe lacing 106. The lacing 106 is threaded through the right eyelet apertures 62 and left eyelet apertures 64 in any conventional manner. The lacing 106 preferably extends across the forefoot opening 54 and across the tongue 74. To alter the aesthetic appearance of the shoe, the lacing 94 could be threaded up across the forefoot opening 54 through only a portion of the eyelet apertures 62, 64. This enables the tongue 74 to be folded over the lacing displaying an interior surface 108 of the tongue. In the preferred embodiment of the invention, the material of the tongue interior surface 108 is the same material as the ankle portion interior surface 92. Thus, when the ankle portion top part 86 is in the folded position displaying the ankle portion interior surface 92, the tongue 74 can be folded over the lacing 106 to also display the tongue interior surface 108. Although the lacing 106 is preferred as the adjustable fasteners used with the shoe, other equivalent fasteners known in the art and used with shoes, for example, elastic bands or hook and loop-type straps, may also be used.

At least one releasable fastener having a first piece 112 and a second piece 114 is provided on the ankle portion exterior surface 88. As shown in the drawing figures, the fastener first piece 112 is provided on the top part 86 of the ankle portion exterior surface and the fastener second piece 114 is provided on the bottom part 84 of the ankle portion exterior surface. This positions the two fastener pieces 112, 114 on opposite sides of the ankle portion fold area 98. When the ankle portion top part 86 is moved to its folded position, the fastener first piece 112 can be releasable fastened to the fastener second piece 114 to hold the ankle portion top part 86 in the folded position. To move the ankle portion top part 86 to the unfolded position, the two pieces 112, 114 of the releasable fastener must be unfastened.

Although the shoe of the invention has been described above by referring to a particular embodiment of the shoe, it should be understood that the modifications and variations could be made to the shoe described without departing from the intended scope of protection provided by the following claims.

The invention claimed is:

1. A shoe construction comprising:

a sole having a toe end and an opposite heel end and having opposite right and left sides extending between the toe end and the heel end;

an upper of flexible material attached to the sole, the upper extending upwardly from the sole to a top edge of the upper, the upper top edge defining a forefoot opening and an ankle opening into an interior of the shoe inside the upper;

a tongue of flexible material attached to the sole, the tongue having a length that extends upwardly from the sole and through the forefoot opening to a distal end of the tongue positioned at the ankle opening;

the upper having an ankle portion with an elongate length that extends upwardly from the sole, the ankle portion having a bottom part that extends upwardly from the sole and a top part that extends from the bottom part, and the ankle portion having a fold area between the bottom part and the top part where the top part is movable between a folded position where the top part overlaps the bottom part and an unfolded position where the top part extends upwardly from the bottom part, where in the folded position more of the ankle portion top part is visible from an exterior of the shoe than the ankle portion bottom part, and in the unfolded position the elongate length of the ankle portion extends upwardly from the shoe sole to an extent where the ankle portion will cover over a shoe wearer's ankle and lower calf;

a releasable fastener with a first piece on the exterior surface of the top part of the ankle portion and a second piece on the exterior surface of the bottom part of the ankle portion, and the first and second pieces are releasably fastenable together with the top part in the folded position to hold the top part in the folded position; and a first plurality of apertures in the ankle portion top part arranged in a line on one side of the forefoot opening and a second plurality of apertures in the ankle portion top part arranged in a line on an opposite side of the forefoot opening.

2. A shoe construction comprising:

a sole having a toe end and an opposite heel end and having opposite right and left sides extending between the toe end and the heel end;

an upper of flexible material attached to the sole, the upper extending upwardly from the sole to a top edge of the upper, the upper top edge defining a forefoot opening and an ankle opening into an interior of the shoe inside the upper;

a tongue of flexible material attached to the sole, the tongue having a length that extends upwardly from the sole and through the forefoot opening to a distal end of the tongue positioned at the ankle opening;

the upper having an ankle portion with an elongate length that extends upwardly from the sole, the ankle portion having a bottom part that extends upwardly from the sole and a top part that extends from the bottom part, and the ankle portion having a fold area between the bottom part and the top part where the top part is movable between a folded position where the top part overlaps the bottom part and an unfolded position where the top part extends upwardly from the bottom part;

the upper ankle portion having an exterior surface with a first indicia and an interior surface with a second indicia;

a releasable fastener with a first piece on the exterior surface of the top part of the ankle portion and a second piece on the exterior surface of the bottom part of the ankle portion, and the first and second pieces are releasably fastenable together with the top part in the folded position to hold the top part in the folded position; and a first plurality of apertures in the ankle portion top part arranged in a line on one side of the forefoot opening and a second plurality of apertures in the ankle portion top part arranged in a line on an opposite side of the forefoot opening.

3. The shoe construction of claim 2, further comprising:
the first indicia and the second indicia being a same indicia.

4. The shoe construction of claim 2, further comprising:
the first indicia being positioned on the bottom part of the upper ankle portion exterior surface where the first indicia is covered by the top part of the upper ankle portion in the folded position.

5. The shoe construction of claim 4, further comprising:
the second indicia being positioned on the top part of the upper ankle portion interior surface where the second indicia is visible from an exterior of the shoe when the top part of the upper ankle portion is in the folded position.

6. The shoe construction of claim 2, further comprising:
the tongue having an exterior surface with the first appearance and an interior surface with the second appearance.

7. A shoe construction comprising:
a sole having a toe end and an opposite heel end and having opposite right and left sides extending between the toe end and the heel end;
an upper of flexible material attached to the sole, the upper extending upwardly from the sole to a top edge of the upper, the upper top edge defining a forefoot opening and an ankle opening into an interior of the shoe inside the upper;
a tongue of flexible material attached to the sole, the tongue having a length that extends upwardly from the sole and through the forefoot opening to a distal end of the tongue positioned at the ankle opening;
the upper having an ankle portion with an exterior surface having a first appearance and an opposite interior surface having a second appearance that is different from the first appearance, the ankle portion having a bottom part that extends upwardly from the sole and a top part that extends from the bottom part, and the ankle portion having a fold area between the bottom part and the top part where the top part is movable between a folded position where the top part overlaps the exterior surface of the bottom part and displays the second appearance of the interior surface over the first appearance of the exterior surface, and an unfolded position where the top part extends upwardly from the bottom part where both the bottom part and top part of the ankle portion display the first appearance of the exterior surface, where in the folded position more of the ankle portion top part is visible from an exterior of the shoe than the ankle portion bottom part, and in the unfolded position the elongate length of the ankle portion extends upwardly from the shoe sole to an extent where the ankle portion will cover over a shoe wearer's ankle and lower calf;
a releasable fastener with a first piece on the exterior surface of the top part of the ankle portion and a second piece on the exterior surface of the bottom part of the ankle portion, and the first and second pieces are releasably fastenable together with the top part in the folded position to hold the top part in the folded position; and
a first plurality of apertures in the ankle portion top part arranged in a line on one side of the forefoot opening and a second plurality of apertures in the ankle portion top part arranged in a line on an opposite side of the forefoot opening.

8. A shoe construction comprising:
a sole having a toe end and an opposite heel end and having opposite right and left sides extending between the toe end and the heel end;
an upper of flexible material attached to the sole, the upper extending upwardly from the sole to a top edge of the upper, the upper top edge defining a forefoot opening and an ankle opening into an interior of the shoe inside the upper;
a tongue of flexible material attached to the sole, the tongue having a length that extends upwardly from the sole and through the forefoot opening to a distal end of the tongue positioned at the ankle opening;
the upper having an ankle portion with an exterior surface having a first appearance and an opposite interior surface having a second appearance that is different from the first appearance, the ankle portion having a bottom part that extends upwardly from the sole and a top part that extends from the bottom part, and the ankle portion having a fold area between the bottom part and the top part where the top part is movable between a folded position where the top part overlaps the exterior surface of the bottom part and displays the second appearance of the interior surface over the first appearance of the exterior surface, and an unfolded position where the top part extends upwardly from the bottom part where both the bottom part and top part of the ankle portion display the first appearance of the exterior surface;
a first indicia on the upper ankle portion exterior surface and a second indicia on the upper ankle portion interior surface, the first indicia being covered by the top part of the upper ankle portion in the folded position and the second indicia being displayed over the first indicia when the top part of the ankle portion is in the folded position;
a releasable fastener with a first piece on the exterior surface of the top part of the ankle portion and a second piece on the exterior surface of the bottom part of the ankle portion. and the first and second pieces are releasably fastenable together with the top part in the folded position to hold the top part in the folded position; and
a first plurality of apertures in the ankle portion top part arranged in a line on one side of the forefoot opening and a second plurality of apertures in the ankle portion top part arranged in a line on an opposite side of the forefoot opening.

9. The shoe construction of claim 8, further comprising:
the first indicia and the second indicia being a same indicia.

10. A shoe construction comprising:
a sole having a toe end and an opposite heel end and having opposite right and left sides extending between the toe end and the heel end;
an upper of flexible material attached to the sole, the upper extending upwardly from the sole to a top edge of the upper, the upper top edge defining a forefoot opening and an ankle opening into an interior of the shoe inside the upper;
a tongue of flexible material attached to the sole, the tongue having a length that extends upwardly from the sole and through the forefoot opening to a distal end of the tongue positioned at the ankle opening;
the upper having an ankle portion with opposite interior and exterior surfaces, the ankle portion having a bottom part that extends upwardly from the sole and a top part that extends from the bottom part, and the ankle portion having a fold area between the bottom part and the top part where the top part is movable between a folded position where the top part overlaps the exterior surface of the bottom part, and an unfolded position where the top part extends upwardly from the bottom part;
a releasable fastener with a first piece on the exterior surface of the top part of the ankle portion and a second piece on the exterior surface of the bottom part of the ankle portion, and the first and second pieces are releasably fastened together with the top part in the folded position to hold the top part in the folded position; and a first plurality of apertures in the ankle portion top part arranged in a line on one side of the forefoot opening and a second plurality of apertures in the ankle portion top part arranged in a line on an opposite side of the forefoot opening.

11. The shoe construction of claim 10, further comprising:

lacing extending through apertures of both the first plurality of apertures and the second plurality of apertures.

12. The shoe construction of claim 10, further comprising:

the upper ankle portion interior and exterior surfaces having different appearances.

* * * * *